US011027442B2

(12) United States Patent
Fuellgrabe et al.

(10) Patent No.: US 11,027,442 B2
(45) Date of Patent: Jun. 8, 2021

(54) PERSONAL CARE DEVICE

(71) Applicant: Braun GmbH, Kronberg (DE)

(72) Inventors: Martin Fuellgrabe, Bad Camberg (DE); Stefan Fuerst, Kronberg (DE); Christian Neyer, Eschborn (DE); Johannes Julian Weinkauff, Frankfurt am Main (DE); Lucy Abigail Zimmermann, Kronberg (DE)

(73) Assignee: Braun GMBH, Kronberg (DE)

( * ) Notice: Subject to any disclaimer, the term of this patent is extended or adjusted under 35 U.S.C. 154(b) by 1 day.

(21) Appl. No.: 16/364,739

(22) Filed: Mar. 26, 2019

(65) Prior Publication Data

US 2019/0299437 A1 Oct. 3, 2019

(30) Foreign Application Priority Data

Mar. 27, 2018 (EP) ..... 18164341

(51) Int. Cl.
*B26B 19/38* (2006.01)
*B26B 19/04* (2006.01)
(Continued)

(52) U.S. Cl.
CPC ..... *B26B 19/388* (2013.01); *B26B 19/042* (2013.01); *B26B 19/386* (2013.01);
(Continued)

(58) Field of Classification Search
CPC ..... B26B 19/388; B26B 19/38; B26B 19/46; B26B 19/3853; B26B 19/382; B26B 21/46; B26B 19/00; B26B 19/28; B26B 21/40; H05B 37/0218; F21L 4/00; F21V 21/26; F21V 21/00; F21V 21/32; A45D 2026/008
(Continued)

(56) References Cited

U.S. PATENT DOCUMENTS 4,930,217 A 6/1990 Wolf et al.
5,189,792 A 3/1993 Otsuka et al.
(Continued)

FOREIGN PATENT DOCUMENTS

CN 1018016 B 8/1992
CN 1688420 A 10/2005
(Continued)

OTHER PUBLICATIONS

European Opinion and Search Report; EP Application No. 18164341; dated Jul. 11, 2018; European Patent Office; Munich, Germany.
(Continued)

*Primary Examiner* — Ghassem Alie
(74) *Attorney, Agent, or Firm* — Kevin C. Johnson

(57) ABSTRACT

A personal care device, in particular skin treatment device such as electric shaver, including an elongated handle for manually moving the personal care device along a body surface, a working head attached to said handle for effecting a personal care treatment to said body surface, at least one detector for detecting at least one behavioral parameter indicative of a user's behavior when handling the personal care device, and an adjusting mechanism for adjusting at least one working parameter of the working head in response to the detected behavioral parameter.

19 Claims, 7 Drawing Sheets

(51) Int. Cl.
*B26B 19/48* (2006.01)
*B26B 19/40* (2006.01)

(52) U.S. Cl.
CPC ..... *B26B 19/40* (2013.01); *B26B 19/48* (2013.01); *B26B 19/3886* (2013.01)

(58) Field of Classification Search
USPC ..... 83/13; 30/45, 34.05, 537; 362/183, 115; 382/376, 308, 311, 222.1, 333.01
See application file for complete search history.

(56) References Cited

U.S. PATENT DOCUMENTS

| | | | |
|---|---|---|---|
| 5,257,456 | A | 11/1993 | Franke et al. |
| 5,687,481 | A | 11/1997 | De Boer et al. |
| 5,745,995 | A | 5/1998 | Yamashita et al. |
| 6,568,083 | B1 | 5/2003 | Taniguchi et al. |
| 6,826,835 | B1 | 12/2004 | Wong |
| 7,364,052 | B2 | 4/2008 | Spatafora |
| 7,832,104 | B2 | 11/2010 | Yamasaki et al. |
| 8,667,692 | B2 | 3/2014 | Kraus |
| 10,179,418 | B2 | 1/2019 | Hendriks et al. |
| 10,576,647 | B2 | 3/2020 | Uit De Bulten et al. |
| 2001/0025421 | A1* | 10/2001 | Damstra ..... B26B 19/38 30/43.6 |
| 2002/0088121 | A1 | 7/2002 | Jacobsen |
| 2004/0098862 | A1* | 5/2004 | Orloff ..... B26B 21/521 30/41.7 |
| 2004/0231160 | A1 | 11/2004 | Shiba et al. |
| 2005/0216035 | A1 | 9/2005 | Kraus et al. |
| 2008/0034591 | A1 | 2/2008 | Fung |
| 2008/0196258 | A1 | 8/2008 | Kraus |
| 2009/0000126 | A1 | 1/2009 | Kraus |
| 2009/0056141 | A1 | 3/2009 | Barry et al. |
| 2009/0119923 | A1 | 5/2009 | Hart et al. |
| 2010/0186234 | A1 | 7/2010 | Binder |
| 2011/0094102 | A1 | 4/2011 | Guan et al. |
| 2011/0094107 | A1 | 4/2011 | Ring et al. |
| 2011/0197726 | A1 | 8/2011 | Kraus |
| 2013/0025078 | A1* | 1/2013 | Heil ..... A61C 17/3436 15/22.1 |
| 2013/0097873 | A1 | 4/2013 | Luo et al. |
| 2015/0020658 | A1 | 1/2015 | Eljaouhari |
| 2015/0032128 | A1 | 1/2015 | Tavlin et al. |
| 2017/0097758 | A1 | 4/2017 | Bauer et al. |
| 2017/0099199 | A1 | 4/2017 | Bauer et al. |
| 2017/0172278 | A1 | 6/2017 | Mehaddene et al. |
| 2017/0291319 | A1 | 10/2017 | Hendriks et al. |
| 2017/0340085 | A1 | 11/2017 | Kindermann |
| 2018/0000219 | A1* | 1/2018 | Roenneberg ..... G05D 15/01 |
| 2018/0236675 | A1 | 8/2018 | Westerhof et al. |
| 2018/0243929 | A1 | 8/2018 | Takechi et al. |
| 2019/0015998 | A1 | 1/2019 | Neyer et al. |
| 2019/0061183 | A1 | 2/2019 | Neyer et al. |
| 2019/0090999 | A1* | 3/2019 | Vetter ..... A46B 15/0002 |
| 2019/0126500 | A1 | 5/2019 | Wu |
| 2019/0224869 | A1 | 7/2019 | Robinson et al. |
| 2019/0299432 | A1 | 10/2019 | Fuerst et al. |
| 2019/0299434 | A1 | 10/2019 | Fuerst et al. |
| 2019/0299435 | A1 | 10/2019 | Fuellgrabe et al. |
| 2019/0299436 | A1 | 10/2019 | Fuellgrabe et al. |
| 2019/0306259 | A1 | 10/2019 | Burghardt et al. |
| 2020/0156272 | A1 | 5/2020 | De Vries et al. |

FOREIGN PATENT DOCUMENTS

| | | | |
|---|---|---|---|
| CN | 202106393 | U | 1/2012 |
| CN | 203197960 | U | 9/2013 |
| CN | 104185537 | A | 12/2014 |
| CN | 204431302 | U | 7/2015 |
| CN | 105835093 | A | 8/2016 |
| CN | 105899336 | A | 8/2016 |
| CN | 106407935 | A | 2/2017 |
| CN | 106778618 | A | 5/2017 |
| CN | 107073727 | A | 8/2017 |
| CN | 107107351 | A | 8/2017 |
| CN | 107414902 | A | 12/2017 |
| CN | 107627329 | A | 1/2018 |
| CN | 107718059 | A | 2/2018 |
| CN | 110303526 | A | 10/2019 |
| CN | 110303531 | A | 10/2019 |
| CN | 110303532 | A | 10/2019 |
| CN | 110303533 | A | 10/2019 |
| DE | 10246519 | A1 | 4/2004 |
| DE | 102005045713 | A1 | 3/2007 |
| DE | 102006004675 | A1 | 8/2007 |
| DE | 102008031132 | A3 | 5/2010 |
| DE | 102010023681 | B4 | 2/2016 |
| EP | 720523 | B1 | 8/1998 |
| EP | 1165294 | B1 | 6/2003 |
| EP | 1854593 | A1 | 11/2007 |
| EP | 1549468 | B1 | 11/2011 |
| EP | 3197649 | B1 | 5/2018 |
| EP | 3546150 | A1 | 10/2019 |
| EP | 3546151 | A1 | 10/2019 |
| EP | 3546152 | A1 | 10/2019 |
| EP | 3546153 | A1 | 10/2019 |
| JP | S5737472 | A | 3/1982 |
| JP | S58-077445 | U | 5/1983 |
| JP | 59184778 | U | 12/1984 |
| JP | 04195302 | A | 7/1992 |
| JP | H06-086873 | A | 3/1994 |
| JP | H6335575 | A | 12/1994 |
| JP | 08152902 | A | 6/1996 |
| JP | H08187376 | A | 7/1996 |
| JP | H9-101804 | A | 4/1997 |
| JP | H09101804 | A | 4/1997 |
| JP | 2000507139 | A | 6/2000 |
| JP | 2000508570 | A | 7/2000 |
| JP | 2003-009937 | A | 1/2003 |
| JP | 2004130153 | A | 4/2004 |
| JP | 2006-501911 | A | 1/2006 |
| JP | 2006255335 | A | 9/2006 |
| JP | 2008501911 | A | 1/2008 |
| JP | 2008043426 | A | 2/2008 |
| JP | 2008307132 | A | 12/2008 |
| JP | 2009-508606 | A | 3/2009 |
| JP | 2009-525090 | A | 7/2009 |
| JP | 2010227223 | A | 10/2010 |
| JP | 2010227224 | A | 10/2010 |
| JP | 2011526168 | A | 10/2011 |
| JP | 2012527939 | A | 11/2012 |
| JP | 201677464 | A | 5/2016 |
| JP | 2016534805 | A | 11/2016 |
| JP | 2017526492 | A | 9/2017 |
| JP | 2017-529168 | A | 10/2017 |
| JP | 2017536948 | A | 12/2017 |
| JP | 2018503420 | A | 2/2018 |
| JP | 2018-532481 | A | 11/2018 |
| JP | 2019171033 | A | 10/2019 |
| JP | 2019171037 | A | 10/2019 |
| JP | 2019171048 | A | 10/2019 |
| JP | 2019171049 | A | 10/2019 |
| JP | 2019171051 | A | 10/2019 |
| JP | 2019171060 | A | 10/2019 |
| WO | 2001013757 | A1 | 3/2001 |
| WO | 2007033729 | A1 | 3/2007 |
| WO | 2014091719 | A1 | 6/2014 |
| WO | 2015067498 | A1 | 5/2015 |
| WO | 2016094327 | A1 | 6/2016 |
| WO | 2016096581 | A1 | 6/2016 |
| WO | 2017032547 | A1 | 3/2017 |
| WO | 2017062326 | A1 | 4/2017 |
| WO | 2018002755 | A1 | 1/2018 |

OTHER PUBLICATIONS

European Opinion and Search Report; EP Application No. 18164343; dated Jul. 9, 2018; European Patent Office; Munich, Germany.
European Opinion and Search Report; EP Application No. 18164344; dated Dec. 14, 2018; European Patent Office; Munich, Germany.

(56) References Cited

OTHER PUBLICATIONS

European Opinion and Search Report; EP Application No. 18164369; dated Jul. 16, 2018; European Patent Office; Munich, Germany.
Japan Search Report; Japan Application No. 2019044483; dated Apr. 23, 2020; Japan Patent Office; Tokyo, Japan.
Notice of Refusal; Japan Application No. 2019044483; dated Jun. 2, 2020; Japan Patent Office; Tokyo, Japan.
Notice of Refusal; Japan Application No. 2019056991; dated Apr. 28, 2020; Japan Patent Office; Tokyo, Japan.
Davies, Samuel Allen; Restriction/Election Requirement; U.S. Appl. No. 16/364,713; dated Jun. 19, 2020; U.S. Patent and Trademark Office; Alexandria, Virginia.
Tanushri Chakravorty; "How Machine Learning Works: An Overview"; Oct. 28, 2016; obtained from https://thenewstack.io/how-machine-learning-works-an-overview; accessed Oct. 5, 2020.
Sofiane Boukhalfa; "IoT and AI Combine to Dominate Consumer Electronics", May 2017, obtained from https://www.prescouter.com/2017/05/iot-ai-consumer-electronics/ accessed Oct. 5, 2020.
Jacques Smuts; "Tutorial on Filters in Control Systems"; Nov. 29, 2016; obtained from https://blog.opticontrols.com/archives/1319; accessed Oct. 5, 2020.
Bermudez-Chacon et al.; "Automatic problem-specific hyperparameter optimization and model selection for supervised machine learning: Technical Report"; 2015, obtained from https://www.research-collection.ethz.ch/bitstream/handle/20.500.11850/107673/eth-48308-01.pdf; accessed Oct. 5, 2020.
Search Report; Chinese Application No. 2019102349467; dated Aug. 26, 2020; Chinese National Intellectual Property Administration; Beijing, China.
Search Report by registered search authority Techno Search, Inc.; Japan Application No. 2019-052818; dated Jun. 17, 2020; Japanese Patent Office; Tokyo, Japan.
Search Report; Chinese Application No. 2019102349433; dated Aug. 17, 2020; Chinese National Intellectual Property Administration; Beijing, China.
Search Report; Chinese Application No. 2019102249740; dated Aug. 31, 2020; Chinese National Intellectual Property Administration; Beijing, China.
Search Report by registered search authority Techno Search, Inc.; Japan Application No. 2019-053167; dated Jun. 16, 2020; Japanese Patent Office; Tokyo, Japan.
Search Report; Chinese Application No. 2019102309169; dated Jun. 20, 2020; Chinese National Intellectual Property Administration; Beijing, China.
Nunziante Calabrese; Extended European Search Report; European Patent Application No. 18164337.0; dated Jul. 18, 2018; EPO; Munich, Germany.
Nunziante Calabrese; Extended European Search Report; European Patent Application No. 18164335.4 9; dated Jul. 18, 2018; EPO; Munich, Germany.
Japanese Search by Registered Search Authority Industrial Property Cooperation Center; Japanese Patent Application No. 2019-052815; dated Jul. 17, 2020; Japanese Patent Office; Tokyo, Japan.
Japanese Search by Registered Search Authority AIRI; Japanese Patent Application No. 2019-047272; dated Apr. 16, 2020; Japanese Patent Office; Tokyo, Japan.
Chinese Search Report; Chinese Application No. 2019102349429; dated Aug. 8, 2020; CNIPA; Beijing, China.
Chinese Search Report; Chinese Application No. 2019102297388; dated Jun. 18, 2020; CNIPA; Beijing, China.

* cited by examiner

PERSONAL CARE DEVICE

FIELD OF THE INVENTION

The present invention relates to a personal care device, in particular skin treatment device such as electric shaver, comprising an elongated handle for manually moving the personal care device along a body surface, a working head attached to said handle for effecting a personal care treatment to said body surface, at least one detector for detecting at least one user's behavior parameter characterizing the user's behavior during the personal care treatment, and an adjusting mechanism for adjusting at least one working parameter of the working head in response to the detected behavioral parameter, said adjustment device including an adjustment actuator controlled by an electronic control unit provided with a control algorithm for calculating an output control signal for the adjustment actuator in response to at least one behavioral input signal indicative of the detected behavioral parameter. More particularly, such personal care device may be a hair removing device such as an epilator or a shaver, wherein such shaver may be an electric shaver comprising at least one cutter unit and, a drive unit for driving said at least one cutter unit. The invention also relates to a method of controlling such personal care device.

BACKGROUND OF THE INVENTION

Electric shavers usually have one or more cutter elements driven by an electric drive unit in an oscillating manner where the cutter elements reciprocate under a shearfoil, wherein such cutter elements or undercutters may have an elongated shape and may reciprocate along their longitudinal axis. Other types of electric shavers use rotatory cutter elements which may be driven in an oscillating or a continuous manner Said electric drive unit may include an electric motor or an electric-type linear motor, wherein the drive unit may include a drive train having elements such as an elongated drive transmitter for transmitting the driving motion of the motor to the cutter element, wherein the motor may be received within the handle portion of the shaver or in the alternative, in the shaver head thereof.

Although such shavers are used on a daily basis by most users, it is sometimes difficult to operate and handle the shaver indeed perfectly. Due to different preferences and habits of different users, often the shaver is not operated in its optimum range. For example, the working head with the cutter elements may be pressed against the skin too strongly, or the shaver may be held at an orientation preventing the working head's shear foils from full contact with the skin, even if the working head is pivotably supported to compensate for some angular displacement. Sometimes it is also difficult to move the shaver along the skin at the right velocity in the right direction to the relevant skin portions. So as to make handling easier and more intuitive, the shaver may provide for various different operating modes and adjustment functions, wherein, however, it is sometimes difficult for a user to find the appropriate setting.

For example, a shaver's drive units are sometimes operable in different operation modes, wherein for example the cutter speed or oscillation frequency may be varied to increase shaving efficiency in a fast mode or highspeed mode, or in the alternative, to avoid skin irritation in a sensitive mode. Depending on the fittings of the shaver, other operation modes may be offered and may include a long-hair cutting mode, wherein a long-hair cutter may be activated and/or moved into a projecting position to allow easier cutting of long hairs.

In addition to such options for different operation modes, personal care devices such as shavers also include self-adjustment functions. For example, it is well known in the field of shavers to moveably suspend the shaver head to allow the cutter elements to self-adjust their position and orientation to better follow the skin contour. More particularly, the shaver head may be pivotably supported to pivot about one or two pivot axes extending transverse to the longitudinal axis of the handle so the working surface of the shaver head may stay in full contact to the skin contour even when the handle is held at a "wrong" orientation. Furthermore, the cutter elements may dive into the shaver head structure so as to compensate for excessive forces pressing the shaver head against the skin.

However, despite such various self-adjustment functions, there is still the problem that one product design must fit all users what is hardly possible. People behave in very different ways and have unique needs such as different types of hair growth when shaving and thus, no single product design can perfectly fit all users.

If the adjustment needs to be made by the user, then this has multiple disadvantages. Firstly, this is inconvenient, which results in the adjustment often not being used. Secondly, it is very often not clear to the user what adjustment is needed to best achieve what he is trying to achieve. A typical example can be illustrated by a common problem: individual missed hairs that are often left uncut during the standard shaving routine. The user then tries in different ways after the rest of the shave to shave these individual hairs. A typical behavior is repeated short strokes over the area with increasing pressure on the cutting elements, whereas decreasing, not increasing, the pressure would be beneficial for this situation.

Alternatively, the adjustment can be automatic. However, existing devices that attempt this, do not deliver an optimal result. Two typical reasons have emerged for the poor performance: On the one hand, when the adjustment is pre-determined, this does not work for all users. For example, the level of shave pressure that leads to skin irritation varies between users and can vary for the same user between days. A shaver that reacts in a pre-determined way to a certain level of shave pressure in order to avoid skin irritation will react too early for some users and too late for others. On the other hand, the high complexity of a shave makes it difficult to find the optimum setting of the adjustable components. More particularly, the quality of the overall shave result and experience depends on the summation of many different interacting shaving parameters, e.g. closeness, skin comfort, time of shave, gliding, skin experience, feeling of control, accuracy of beard contours, etc. These shaving parameters are in turn influenced by the combination of multiple parameters, which again have their own complex interactions.

Document EP 0 720 523 B1 discloses an electric shaving apparatus which allows for adjusting the height over which the cutter elements project from the shaver head surface, adjusting the pretensioning force of the cutter blades against which pretensioning force the cutter blades may dive, and adjusting the motor speed so as to balance shaving performance and skin irritation. Said adjustable parameters, i.e. cutter height, pretensioning force and motor speed, are automatically controlled in response to a plurality of detected working parameters including measured skin contact force and an acoustic signal measured by a microphone which signal is assumed to indicate a number of hairs cut by the cutter. Although the control uses fuzzy logic to balance the influence of the different input signals indicative of the different working parameters, the achieved self-adjustment of the shaver is still insufficient in terms of fitting different user's needs and different user's preferences.

Furthermore, WO 2007/033729 A1 discloses an electric hair removal device adjusting the motor speed and thus cutter speed in response to the velocity at which the hair removal device is moved along the user's skin which velocity is measured by means of a rotational sensor. The shaver includes a memory in which velocity detected in the past is stored so as to start a hair removal session with a motor speed in line with the stored velocity detected in the past.

Document WO 2015/067498 A1 discloses a hair cutting device, wherein a position identifier including cameras identifies the position of the hair cutter relative to the body part to be treated, wherein a feedback module gives feedback to indicate the desired path and the desired angle of orientation of the cutter relative to the body part.

Furthermore, document WO 2017/062326 A1 describes a personal care device linked to a smartphone and a computer system via a network so as to monitor device usage. More particularly, working time is monitored to indicate when a replacement part such as a razor cartridge needs to be replaced, wherein determination of working time includes adjustment of the sensor settings such as the minimum duration for counting a shaver stroke.

Furthermore, document WO 2017/032547 A1 discloses a shaving device giving a user shaving instructions acoustically and/or visually, wherein such shaving instructions such as "user gentle pressure only" or "use sensitive speed setting" are given based on usage data such as pressure data and/or motion data measured by the shaving device. It is also suggested to take into account usage data history to select the appropriate instruction from a stored list of instructions.

EP 1549468 B1 describes a shaver which detects proper contact of the shear foils with the skin to be shaved, wherein it is mentioned that such contact may be detected by means of an inductive sensor, a capacitance sensor or an optical sensor which may include a light barrier immediately above the shear foil. It is suggested to automatically vary the position of the shaver head relative to the handle by means of an actuator for pivoting or tilting the shaver head, when there is improper contact to the skin.

SUMMARY OF THE INVENTION

It is an objective underlying the present invention to provide for an improved personal care device avoiding at least one of the disadvantages of the prior art and/or further developing the existing solutions. A more particular objective underlying the invention is to provide for an improved self-adjustment of the personal care device to the user.

A further objective underlying the invention is to provide for an improved personal care device automatically modifying at least one of its adjustment functions so that less adaptation from the user to the product is necessary.

A still further objective underlying the invention is to achieve better self-adjusting to complex interaction of characteristics of treatment situations.

To achieve at least one of the aforementioned objectives, it is suggested to not rely on a predetermined control algorithm controlling the adjustment actuator in a predetermined way in response to detected parameters, but to modify the control algorithm in response to input signals that include at least one input signal different from the signals the control algorithm uses for calculation of the output control signals. More particularly, the electronic control unit, in addition to the aforementioned control algorithm, is provided with a modification algorithm for modifying the control algorithm on the basis of at least one modification input signal. Such modification input signal may be different from the behavioral input signal in response to which the control algorithm calculates the output control signal for the adjustment actuator in terms of, e.g., coming from different detectors and/or representing real time data on the one hand and historical data on the other hand. Due to such additional modification algorithm, a more flexible adjustment of the working parameters of the personal care device to different users' behavior and preferences, and the adjustment is more responsive to complex patterns of treatment characteristics.

The modification algorithm may modify the control algorithm in different ways. For example, the modifying algorithm may be configured to modify the calculation rule according to which the control algorithm calculates the output control signal from the behavioral input signal. Thus, although the behavioral input signal may stay the same, the output control signal may become different or may vary when the calculation rule is modified by the modification algorithm on the basis of a changing modification input signal.

More particularly, the modification algorithm may shift or modify or change a characteristic curve defining the relationship between the at least one behavioral input signal and the output control signal, wherein, for example, the slope of said curve may be changed so that said slope becomes steeper or less steep, and/or a curvature of said curve may be changed and/or said curve may be displaced. When modifying the rule of calculation implemented in the control algorithm, the control function and/or data processing effected by the control algorithm is changed or modified so the output control signal may be calculated differently although the behavioral input signal input into the control algorithm may stay constant.

According to another aspect of the invention, the personal care device may have a pivotable suspension of its working head to allow for pivoting of the working head relative to the handle about at least one axis, wherein the adjustment mechanism is configured to adjust the pivoting stiffness of the working head's suspension and/or the resistance and/or unwillingness of the working head against pivoting movements so as to give the personal care device a more aggressive, performance-oriented handling on the one hand and a more comfortable, smoother handling on the other hand, depending on the user's behavior. More particularly, the adjustment mechanism may vary the torque and/or force necessary to pivot the working head relative to the handle and/or to achieve a certain pivot angle of the working head deviating from a neutral position thereof.

In addition or in the alternative, the adjustment mechanism may be configured to adjust the angular pivoting range of the working head to allow a larger or smaller maximum angular displacement. The personal care device will give a more aggressive, performance-oriented feeling to the user when the maximum available pivoting angle is smaller, whereas a more comfortable, smoother feeling is provided with a larger maximum pivoting angle.

Such adjustment of the pivoting stiffness and/or the angular pivoting range of the working head may be automatically controlled by the control algorithm in response to at least one behavioral parameter selected from the group of parameters comprising skin contact pressure of one or more working elements or the entire working head, velocity at which the personal care device is moved along a body portion to be treated, frequency of strokes, angular orientation of the personal care device relative to the gravitational field and position of fingers gripping the handle and position of the working head relative to the body to be treated. For example, pivoting stiffness of the working head may be adjusted in response to skin pressure with which the working head is pressed against the skin of a user, wherein such skin pressure can be detected by a suitable skin pressure sensor. When a user of a shaver, for example, encounters difficulties in getting longer hairs cut, the user usually presses the shaver head stronger against the skin, wherein the user may get the impression that the shaver head pivots too easily. Thus, when detecting an increased skin pressure, the adjustment mechanism may increase the pivoting stiffness.

In addition or in the alternative, when a user moves the personal care device at high velocities over the body portion to be treated and/or at a high stroke frequency, the user may need quicker pivoting of the working head and thus less pivoting stiffness so the adjustment mechanism may increase pivoting stiffness in response to an increase in velocity and/or stroke frequency as detected by a corresponding sensor.

In addition or in the alternative, the adjustment mechanism may increase pivoting stiffness when a change of the finger grip position on the handle is detected and/or a change of the angular orientation of the handle and/or angular rotation of the handle is detected what indicates the user is adapting to the device, when, for example, a user is shaving a neck portion. Typically, when shaving the neck area, a user will rotate the shaver around the longitudinal axis of the handle and change the finger grip position such that the shaver's front side points away from the user. Additionally, the user then rotates the shaver around an axis parallel to the swivel axis of the shaver head. Based on detection of such behavioral parameters, the adjustment mechanism may increase the pivoting stiffness and or reduce the pivoting range.

These and other advantages become more apparent from the following description giving reference to the drawings and possible examples.

DETAILED DESCRIPTION OF THE INVENTION

Figure 1:
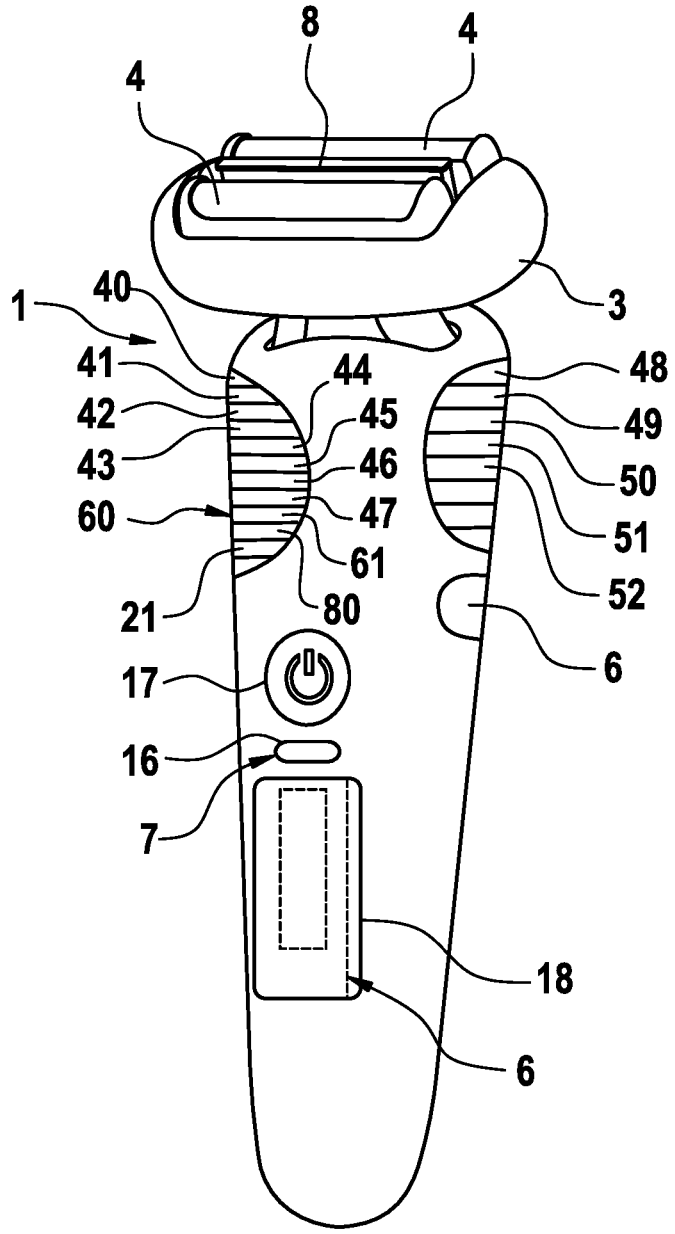
FIG. 1: a perspective view of a personal care device in terms of an electric shaver comprising a handle and a shaver head pivotably connected thereto, wherein pivoting stiffness of the shaver head and diving or floating resistance of the cutter elements may be adjusted in response to user behavior.

The personal care device offers comfortable ways of self-adapting to different preferences and behavior of different users.

More particularly, to achieve better self-adjusting to complex interaction of characteristics of treatment situations, it is suggested to not rely on a predetermined control algorithm controlling the adjustment actuator in a predetermined way in response to detected parameters, but to modify the control algorithm in response to input signals that include at least one input signal different from the signals the control algorithm uses for calculation of the output control signals. More particularly, the electronic control unit, in addition to the aforementioned control algorithm, is provided with a modification algorithm for modifying the control algorithm on the basis of at least one modification input signal Due to such additional modification algorithm, a more flexible adjustment of the working parameters of the personal care device to different users' behavior and preferences, and the adjustment is more responsive to complex patterns of treatment characteristics.

The modification algorithm may modify the control algorithm in different ways. For example, the modifying algorithm may be configured to modify the calculation rule according to which the control algorithm calculates the output control signal from the behavioral input signal. Thus, although the behavioral input signal may stay the same, the output control signal may become different or may vary when the calculation rule is modified by the modification algorithm on the basis of a changing modification input signal.

Contrary to for example fuzzy logic, the control algorithm in terms of the calculation rule or set of calculation rules is indeed changed so, after a modification of the control algorithm, the same behavioral input signals do no longer result in the same actuation of the adjustment actuator. Fuzzy logic models used in the prior art may provide for different output calculation functions for different subranges of a continuous variable and may provide for multiple membership function to determine the output depending on membership of an input to a certain subrange or membership of a plurality of inputs to a certain combination of subranges. However, for a given combination of input signals having given values, the rule of calculation of the output is predetermined and is not modified so the output of the fuzzy logic is always the same for such given combination of input signals. In contrast, the modification algorithm of the personal care device described herein indeed modifies the calculation rule of the control algorithm so the output control signal may become different although the behavioral input signal to which the control algorithm is applied is the same.

More particularly, the modification algorithm may shift or modify or change a characteristic curve defining the relationship between the at least one behavioral input signal and the output control signal, wherein, for example, the slope of said curve may be changed so that said slope becomes steeper or less steep, and/or a curvature of said curve may be changed and/or said curve may be displaced.

When there are two or more behavioral input signals related to an output control signal in terms of a map defining such relationship and/or two or more output control signals related to one or more behavioral signal(s) in terms of a map, on the basis of which map the control algorithm determines the output control signal(s), the modification algorithm may modify such map in response to at least one modification input signal. For example, the position and/or contour of an elevation and/or depression in said relief-like map may be changed, or the slope of an inclined portion of said map may be changed so that said slope becomes steeper or less steep, and/or a curvature of a face of a contour in said map may be changed and/or an elevation and/or depression may be displaced. It also would be possible to change the level and/or inclination of the entire map in response to a modification input signal input to said modification algorithm.

When modifying the rule of calculation and/or said curve and/or said map implemented in the control algorithm, the control function and/or data processing effected by the control algorithm is changed or modified so the output control signal may be calculated differently although the behavioral input signal input into the control algorithm may stay constant.

In addition or in the alternative, the modification algorithm may be configured to modify the data collection of the control algorithm. More particularly, the modification algorithm may modify the control algorithm such that the control algorithm uses a reduced or increased number of behavioral input signals and/or uses different behavioral input signals in terms of, e.g., replacing a behavioral input signal coming from a first sensor by a behavioral input signal coming from a second sensor, and/or producing an increased or decreased number of output control signals and/or producing different output control signals for different adjustment actuators.

The at least one modification input signal on the basis of which the modification algorithm modifies the control algorithm, may be different from the behavioral input signal in terms of, e.g., coming from different detectors and/or having been detected at different points of time during the personal care treatment. For example, when skin contact pressure and stroke frequency are detected as behavioral parameters in response to which the control algorithm sends control signals to the adjustment actuator to adjust pivoting stiffness of the working head, the modification input signal may come from a finger position sensor detecting the finger position on the personal care device's handle so as to modify the control algorithm and thus, the relationship between pivoting stiffness on the one hand and skin pressure and stroke frequency on the other hand, in response to the finger grip position. For example, the control algorithm may set the adjustment actuator to a position providing for maximum pivoting stiffness when the product of detected skin pressure and detected stroke frequency exceeds a certain threshold. If the finger position sensor provides for a signal indicative of a finger grip position typically used when shaving the neck, the modification algorithm may modify the aforementioned control algorithm to limit the control signals for setting pivoting stiffness to not exceed 75% of the aforementioned maximum stiffness, for example, even when said product of skin pressure and stroke frequency exceeds said threshold.

In addition or in the alternative, the modification algorithm may use a modification input signal coming from the same detector as the behavioral signal. More particularly, the modification algorithm may use historical values of the detected behavioral parameter as modification input signal, whereas the control algorithm uses the current real time value of the detected behavioral parameter as behavioral input signal. For example, when skin pressure and stroke frequency, in particular real time values thereof, are considered by the control algorithm as behavioral input signal, the modification algorithm may modify the control algorithm in response to historical values of the skin pressure detected, e.g., during past personal care treatment sessions.

In addition or in the alternative, the modification algorithm may not only use values such as historical values of a behavioral parameter as modification input signal, but also may use processed data of a behavioral parameter such as rate of change, maximum amplitudes and/or mean values of a behavioral parameter detected during a past and/or current personal care treatment as modification input signal.

The modification algorithm may determine the modification from the modification input signal in different ways. For example, the modification algorithm may be configured to apply a statistical evaluation of the modification input signal to determine, e.g., a mean value of the modification input signal, a spread of the modification input signal, minimum and/or maximum values of the modification input signal and/or a median value and/or a sliding average thereof. On the basis of such statistical evaluation, the modification algorithm may modify the control algorithm to adjust the output control signal.

In addition or in the alternative, the modification algorithm may be configured to effect a filtering to the modification input signal and/or to the behavioral input signal, and/or a smoothening to the modification input signal and/or the behavioral input signal, and/or a mapping and/or an over- and/or undersampling and/or a combination of input quantities.

In addition or in the alternative, the modification algorithm may determine how the at least one modification input signal and/or the at least one behavioral input signal has changed with time and/or may compare said at least one modification input signal and/or said at least one behavioral input signal with a reference parameter to determine, e.g., a difference therebetween.

According to a further aspect, the modification algorithm is configured to continuously and/or repeatedly modify the control algorithm during regular operation of the personal care device, i.e. during effecting a personal care treatment. In particular, the control algorithm may be modified during normal use of the personal care device automatically. During normal usage means for example that the device does not need to be switched into a special/calibration mode or a special calibration procedure does not need to be conducted to detect the parameters. This would be inconvenient. It also means that the data collection time is maximized which has the advantage that as much data as possible is collected and also that the data collection is always up to date. Automatically means for example that the user does not need to press a switch, provide input such as answering questions, select options, etc. for the data collection to take place.

The at least one behavioral input signal in response to which the control algorithm calculates the output control signal may be a real time signal as detected, e.g., by the at least one detector detecting the behavioral parameter indicative of a user's behavior during handling the personal care device. The behavioral input signal that is input into the control algorithm may directly correspond to the signal provided by said detector. In the alternative, the detector signal or sensor signal may be subject to signal processing and/or signal transformation before it is input into the control algorithm. For example, the detector signal indicative of the user's behavior may be subject to filtering and/or noise reduction and/or amplification to become the behavioral input signal which is then input into the control algorithm.

In addition or in the alternative, the detector signal may be combined with other detector signals to become the behavioral input signal that is input into the control algorithm. For example, when there are two or three pressure sensors measuring skin contact pressure, the corresponding detector signals may be summed up, wherein the sum potentially divided by the number of detectors can be input into the control algorithm. In addition or in the alternative, the detector signals may be subtracted from one another to identify, e.g., an uneven pressure distribution across different elements, wherein such result of the subtracted values indicative of uneven pressure distribution may be input into the control algorithm.

Such behavioral signal may be detected by different sensors or detectors and may be indicative of different characteristics of a user's behavior when handling the personal care device. For example, at least one detector such as an accelerometer may be used to detect stroke properties such as speed, acceleration, length, direction, orientation, frequency, pattern, repetitive strokes over the same area and all derivatives of these quantities, and/or device orientation and/or movement, such as position, acceleration, speed, movement frequencies, movement pattern and derivatives of these quantities, and/or vibrations of the shaver head, the shaver handle, cutting elements and/or skin areas.

In addition or in the alternative, at least one detector such as a gyroscope may be used to detect stroke properties such as direction, orientation, frequency, pattern, related to rotational movements of the shaver and all derivatives of these quantities, and/or orientation and movement of the device and/or parts thereof such as head or body, e.g. position, acceleration, speed, movement frequencies, movement pattern, related to rotational movements of the shave and derivatives of these quantities. These may be measured in absolute terms and/or relative to other objects such as the user's face or arm/hand.

Furthermore, at least one detector may be used for motion tracking and/or motion capturing, e.g. including stroke properties such as speed, acceleration, length, direction, orientation, frequency, pattern, and all derivatives of these quantities, device orientation and movement, such as position, acceleration, speed, movement frequencies, movement pattern and derivatives of these quantities, and/or user orientation and movement, such as position, acceleration, speed, movement frequencies, movement pattern, use of second hand (e.g. for skin stretching or trying to get a single missed hair). This can be absolute or relative to the shaver or any other object such as a bathroom mirror.

In addition or in the alternative, at least one detector such as a camera or other optical sensor may be used to detect grimaces, tipping of head and/or skin tensions or folds.

In addition or in the alternative, at least one detector such as a pressure, e.g. capacitive or resistive touch sensor or other force measuring sensor may be used to detect skin contact force between face and the working head and/or cutting parts of a shaver head, and/or the force on each cutting element and distribution across the different elements, In addition or in the alternative, at least one detector such as a touch sensor, e.g. capacitive or resistive touch sensors may detect gripping force and/or gripping surface—location and/or area, and/or type of grip.

In addition or in the alternative, at least one detector such as force sensor, which may be configured 1-dimensional, 2-dimensional, or 3-dimensional, may detect a resultant direction that the user is pressing the device against the skin.

In addition or in the alternative, at least one detector such as hall sensor may detect movements of parts of the device relatively to each other due to external forces.

In addition or in the alternative, at least one detector such as motor current based detection systems may determine parameters such as skin contact force, hair cutting activity and/or a wear state of cutting elements.

All the aforementioned detectors and sensors could be in the personal care device itself or external to the device, e.g. motion tracking equipment, wearable electronics such as a smart watch or in an external device such as a smart phone.

The at least one modification input signal used by the modification algorithm for modifying the control algorithm may include any of the aforementioned parameters and signals provided by anyone of the aforementioned detectors and sensors, and furthermore, it also may come from different sources and/or may be indicative of different characteristics of the personal care treatment and/or the user's behavior and/or a user's preference and/or ambient conditions during the personal care treatment. For example, the at least one modification input signal may correspond to data collected by the personal care device itself. More particularly, the at least one modification input signal may be a detector signal and/or a sensor signal of a detector and/or sensor provided at the personal care device.

In addition or in the alternative, data from external sources such as from a cloud, a smartphone, a corporation server, a cleaning center and/or loading center for loading and/or cleaning the personal care device, and/or from a smartwatch and/or other peripheral devices may be used as the at least one modification input signal.

The modification input signal may be indicative of different characteristics. For example, the modification input signal may be indicative of a behavioral and/or environmental and/or physiological parameter indicative of a user's behavior when handling the personal care device and/or indicative of an environmental characteristic such as humidity and/or a physiological characteristic such as hair length or hair density.

The modification input signal may be a real time signal indicative of the respective characteristic as it is during the personal care treatment session. In addition or in the alternative, the modification input signal may include past values. More particularly, the modification input signal may include information on trends and/or gradients and/or developments of the aforementioned characteristics.

Basically, the modification algorithm may use the same signal as modification input signal as the control algorithm uses for calculating the output control signal, wherein, e.g., the modification algorithm may determine statistical evaluation from such signal such as trends and/or gradients and/or average values to modify the control algorithm.

In addition or in the alternative, the modification algorithm uses also other data and/or signals as modification input signals to determine the modification applied to the control algorithm. For example, when the control algorithm varies a pivoting stiffness of the working head, i.e. the resistance of the working head against pivoting relative to the handle, in response to skin contact pressure determined by a skin contact pressure sensor, the modification algorithm may use stroke frequency to modify the control algorithm. For example, when stroke frequency is low, the control algorithm may be modified to consider, e.g., 4 N to be a high pressure, whereas when stroke frequency is high, the modification algorithm may modify the control algorithm to consider 2 N as high pressure. Thus, the control algorithm may adjust the working head's pivoting stiffness to be high when there is a low stroke frequency and the skin contact pressure reaches 4 N, whereas, on the other hand, high pivoting stiffness is set when there is a high stroke frequency and the skin contact pressure reaches 2 N.

According to a further aspect, the modification algorithm may adapt the adjustment mechanism of the personal care device to the level and/or quality of the detected behavioral parameter so as to adapt the adjustment function to the individual behavior of the user. More particularly, the personal care device may include a calibration device for calibrating the relation between the adjustment of the at least one working parameter by the adjusting mechanism to the detected behavioral parameter in response to the history of the detected behavioral parameter as well as current values thereof. When a certain detected behavioral parameter changes within a certain range during a current treatment session and/or has changed within a certain range during past-treatment session, the adjustment mechanism may be calibrated to consider a current value of the behavioral parameter at an upper limit of the aforementioned, determined range or above said range to be at a high level and/or a current value in the middle of said range to be an average level value and/or a current value at a lower limit of said range or even below said lower limit to be a low-level value of said behavioral parameter. Due to such calibration, the adjustment mechanism may adjust the working parameter in a way fitting better the individual user's needs.

For example, when a skin contact pressure is detected as behavioral parameter, a first user may handle the personal care device with a skin contact pressure ranging from 2 to 4 N so, by means of the aforementioned calibration device, the adjustment mechanism may learn to consider 2 N to be a low pressure for this user, whereas 4 N would be a high pressure. On the other hand, when another user handles the personal care device with a skin contact pressure ranging from 1 to 2 N the adjustment mechanism would learn 2 N is a high pressure, whereas 1 N is a low pressure. Depending on the type of adjustment and/or depending on the working parameter, the adjustment mechanism may set the working parameter to a high level, when the detected behavioral parameter reaches 4 N for the first user, and to a low level when the skin contact pressure reaches 2 N for said first user, whereas the working parameter could be set to a high-level setting when 2 N are detected for a second user.

A further specific example of when the algorithm might self-modify is when it recognizes that it is being used by a different user, e.g. by detecting very different behavior to usual. In this case, the algorithm may modify itself back to the default/factory setting assuming that it has already modified the setting for the first user.

The working parameters which may be adjusted by the adjustment mechanism, may comprise different physical settings and/or functions of the device affecting the personal care treatment, such as a mechanical setting or mechanical function of the working head and/or of the working tool and/or of a drive unit or drive train of the device. More particularly, a working parameter changing the way the personal care treatment is applied, can be adjusted. Such mechanical settings or functions may include the movability of the working head relative to the handle and/or the operation of one or more working tools such as a long-hair cutter and the positions thereof relative to other tools, and/or the temperature of a cooling/heating element for cooling/heating the skin, and/or the operation of a lubricant applicator for applying a lubricant to the body portion to be treated.

Such working parameters which are adapted, may be characteristic of functional properties of the personal care device and may include at least one of the following: height of different cutting elements and/or non-cutting elements, e.g. guard, combs, etc., relative to each other, blade frequency, blade amplitude, floating force of individual cutting elements, force needed to swivel/tilt head, ratio between area of cutting parts to area of non-cutting parts in terms of e.g. head frame in contact with user's skin, skin tensioning elements, 3D angle of head relative to body, height of head relative to body, foil hole size and/or pattern, shaver head vibrations, handle vibrations.

According to another aspect of the invention, the personal care device may have a pivotable suspension of its working head to allow for pivoting of the working head relative to the handle about at least one axis, wherein the adjustment mechanism is configured to adjust the pivoting stiffness of the working head's suspension and/or the resistance and/or unwillingness of the working head against pivoting movements so as to give the personal care device a more aggressive, performance-oriented handling on the one hand and a more comfortable, smoother handling on the other hand, depending on the user's behavior. More particularly, the adjustment mechanism may vary the torque and/or force necessary to pivot the working head relative to the handle and/or to achieve a certain pivot angle of the working head deviating from a neutral position thereof.

In addition or in the alternative, the adjustment mechanism may be configured to adjust the angular pivoting range of the working head to allow a larger or smaller maximum angular displacement. The personal care device will give a more aggressive, performance-oriented feeling to the user when the maximum available pivoting angle is smaller, whereas a more comfortable, smoother feeling is provided with a larger maximum pivoting angle.

Such adjustment of the pivoting stiffness and/or the angular pivoting range of the working head may be automatically controlled in response to at least one behavioral parameter selected from the group of parameters comprising skin contact pressure, velocity at which the personal care device is moved along a body portion to be treated, frequency of strokes, angular orientation of the personal care device relative to the gravitational field and position of fingers gripping the handle and position of the working head relative to the body to be treated. For example, pivoting stiffness of the working head may be adjusted in response to skin pressure with which the working head is pressed against the skin of a user, wherein such skin pressure can be detected by a suitable skin pressure sensor. When a user of a shaver, for example, encounters difficulties in getting longer hairs cut, the user usually presses the shaver head stronger against the skin, wherein the user may get the impression that the shaver head pivots too easily. Thus, when detecting an increased skin pressure, the adjustment mechanism may increase the pivoting stiffness.

In addition or in the alternative, when a user moves the personal care device at high velocities over the body portion to be treated and/or at a high stroke frequency, the user may need quicker pivoting of the working head and thus less pivoting stiffness so the adjustment mechanism may increase pivoting stiffness in response to an increase in velocity and/or stroke frequency as detected by a corresponding sensor.

In addition or in the alternative, the adjustment mechanism may increase or decrease pivoting stiffness when a change of the finger grip position on the handle is detected and/or a change of the angular orientation of the handle and/or angular rotation of the handle is detected what indicates the user is adapting to the device, when, for example, a user is shaving a neck portion. Typically, when shaving the neck area, a user will rotate the shaver around the longitudinal axis of the handle and change the finger grip position such that the shaver's front side points away from the user. Additionally, the user then rotates the shaver around an axis parallel to the swivel axis of the shaver head. Based on detection of such behavioral parameters, the adjustment mechanism may increase the pivoting stiffness and or reduce the pivoting range.

In addition or in the alternative, pivoting stiffness and/or at least another adjustable working parameter of the personal care device may be adjusted in response to other parameters such as environmental parameters. For example, at least one environmental detector may detect air humidity and/or air temperature, wherein the pivoting stiffness and/or floating stiffness and/or cutter speed and/or cutter frequency may be adjusted in response to detected air humidity and/or air temperature.

In the alternative or in addition, the pivoting stiffness may be adjusted in response to a physiological parameter of the user which may be detected by a suitable physiological detector. For example, density and/or length of hairs on a skin portion to be shaved may be detected by a visual or optical sensor such as a camera. Furthermore, skin moisture may be detected to adjust one of the aforementioned working parameters such as pivoting stiffness.

In addition to sensor data detected during normal use of the shaver, other pieces of information may be used to adapt the self-adjustment function of the personal care device to a user's preferences. For example, a database of one or more known user adaptions may be used to identify when the particular user is adapting his behavior to the shaver, optionally also including typical adaptions for known physiological and/or climatic conditions, wherein such data base may be based on large-scale consumer research and/or may receive updates during the lifetime of the product. The control unit of the personal care device may compare the individually detected parameters to data from the database to find out if the detected data indicates normal, average behavior and/or normal/average parameters and/or represent an adaptive behavior.

In addition or in the alternative to such reference data from a database, adjustment of the personal care device also may be achieved on the basis of data collected from the user himself/herself. For example, the device may include input means such as a touchscreen to input a user's preferences.

A display device may include at least one display field which is used for displaying information relative to setting choices as well as information relative to other aspects of the shaver such as the aforementioned charging level, shaving time, cleaning status or wear and tear status. For example, such display field may be configured to display pictograms such as a cascade or row of display points in terms of for example a row of LEDs or a single LED.

In addition or in the alternative to visually displaying such relevant information, there may be other means of communication to communicate such information to a user. For example, audio output means may output audible signals such as speech to communication the information to the user.

In addition or in the alternative to a display or other information output provided on the electric shaver itself, a display such as a touch display and/or other communication means may be provided on a cleaning and/or loading station configured to receive and/or be connected to the electric shaver so as to charge the shaver's battery and/or clean the shaver, wherein a fluid may be applied to the shaver head to clean the shaver. Such cleaning and/or charging station may include a display device and/or an audio output device or another communicator configured to communicate with the electric shaver at least when the shaver is docked into the station so as to display and/or input the aforementioned information.

Such communication means provided on the personal care device itself and/or an auxiliary station thereof, also may be configured to allow for inputting of a reset mode bringing the personal care device back to its factory setting to allow for fresh adjustment and/or an override function to enable the user to set and/or modify and/or use a different device functional property from that determined by the control algorithm. In addition or in the alternative, the communication means may be configured to allow a user for selecting different operation modes. For example, a sport mode or a comfort mode may be chosen so as to influence how quickly the self-modifications take place.

In addition or in the alternative a startup mode may be provided every time the device is touched and/or powered on as a functional signal to the user to welcome same or to indicate its abilities or its readiness. This functional signal may be e.g. a motorized swivel of the shaver head from a first position into a second position, a motor sound, a light or display signal.

These and other features become more apparent from the example showing in the drawings. As can be seen from FIG. 1, the shaver 1 may have a shaver housing forming a handle 2 for holding the shaver, which handle may have different shapes such as—roughly speaking—a substantially cylindrical shape or box shape or bone shape allowing for economically grabbing the shaver.

On one end of the shaver 1, a shaver head 3 is attached to the handle, wherein the shaver head 3 may be slewably supported about one or more slewing axes.

The shaver head 3 includes at least one cutter unit 4 which may include a cutter element or undercutter reciprocating under a shearfoil. The shaver head 3 may also include a long hair cutter 8 as it is shown by FIG. 1.

So as to drive such cutter unit 4 and the long hair cutter 8, a drive unit 5 may include a motor that can be received within the handle 2 and can be connected to the cutter unit 4 and the long hair cutter 8 by means of a transmitter or drive train extending from the motor to the cutter unit.

As can be seen from FIG. 1, an ON-OFF switch or power switch 17 may be arranged at the handle 2. By means of such power switch 17, the drive unit 5 may be started and switched off again.

As can be seen from FIG. 1, the shaver 1 further includes a display 18 which may be provided on the handle 2, for example on a front side thereof. Such display 18 may be a touch display device allowing individual setting preferences to be input.

As can be seen from FIG. 1, the shaver 1 may include further input elements 7 in terms of, for example, a touch-button 16 which may be positioned in the neighborhood of the power switch 17.

Several working parameters and/or working functions of the shaver 1 can be adjusted by means of an adjustment device 6 which may change mechanical settings and/or operational settings of the shaver such as the pivoting stiffness of the shaver head 3 and the position and/or operation of the long-hair cutter 8 as will be described in detail. Such adjustment device 6 may include one or more adjustment actuators AA such as electric motors or electric actors or actors of other types using other forms of energy such as magnetic actors. Such adjustment actuators may be controlled by a control unit 80, wherein such control unit 80 may include an electronic control unit, in particular a micro-controller working on the basis of software stored in a memory.

Such control unit 80 may take into account different treatment parameters which are detected during operation of the shaver 1 by a plurality of detectors. In addition, the control unit 80 also may be responsive to a history of the values of detected parameters of the current shaving session and/or a previous shaving session, as will be described in greater detail.

Figure 2:
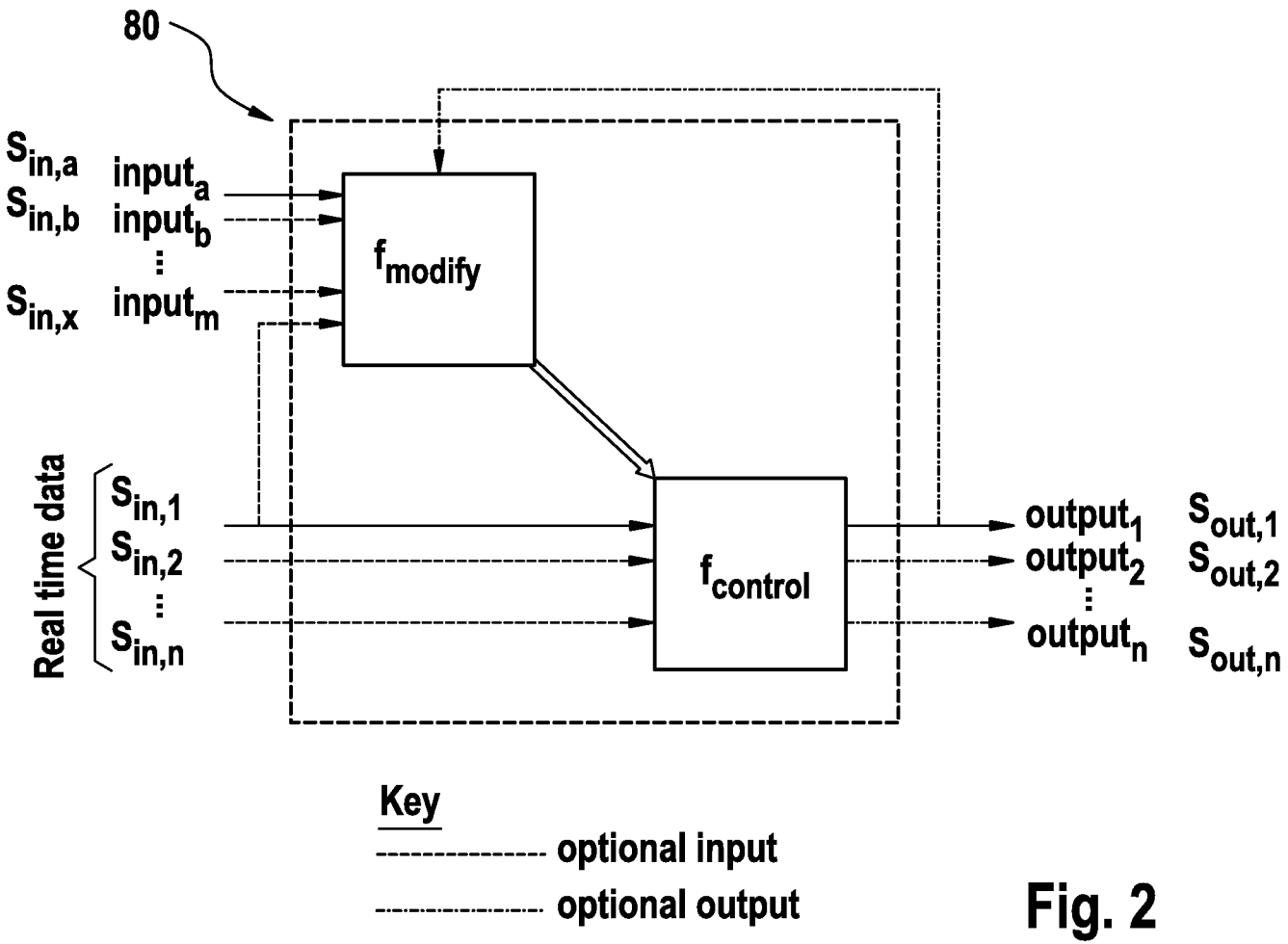
FIG. 2: a schematic diagram showing the structure of the control unit including a control algorithm and a modification algorithm, wherein the input and output signals to the algorithms are illustrated.

As can be seen from FIG. 2, the control unit 80 includes a control algorithm $f_{control}$ for calculating an output control signal $S_{out,\ 1\text{-}n}$ for the one or more adjustment actuators AA in response to at least one behavioral input signal $S_{in,\ 1\text{-}n}$ indicative of at least one detected behavioral parameter.

In addition to such control algorithm $f_{control}$, the electronic control unit 80 is provided with a modification algorithm $f_{modify}$ for modifying the aforementioned control algorithm $f_{control}$ on the basis of at least one modification input signal $S_{in,\ a\text{-}x}$ different from the aforementioned behavioral input signal $S_{in,\ 1\text{-}n}$. More particularly, said modification algorithm $f_{modify}$ also may use the behavioral input signals as modification input signals, but it uses at least one modification input signal different from said behavioral input signals.

Such behavioral input signals $S_{in,\ 1\text{-}n}$ and/or said modification input signals $S_{in,\ a\text{-}x}$ may come from detectors and/or sensors for detecting and/or measuring relevant parameters, as will be described in greater detail.

Such detectors may include in particular a force detector 41 for detecting the force with which the working head 3 is pressed onto the body surface 30. Such force detector 41 may include various sensing means such as a sensor measuring diving of the working head 3 towards the handle 2, a sensor measuring bending stresses in the handle or a sensor measuring torque and/or load of a motor driving the working tools which are all representative of contact pressure.

In response to detected pressure or force with which the working head is pressed against the skin, the control unit 80 may vary the pivot stiffness of the shaver head 3, for example.

Figure 7:
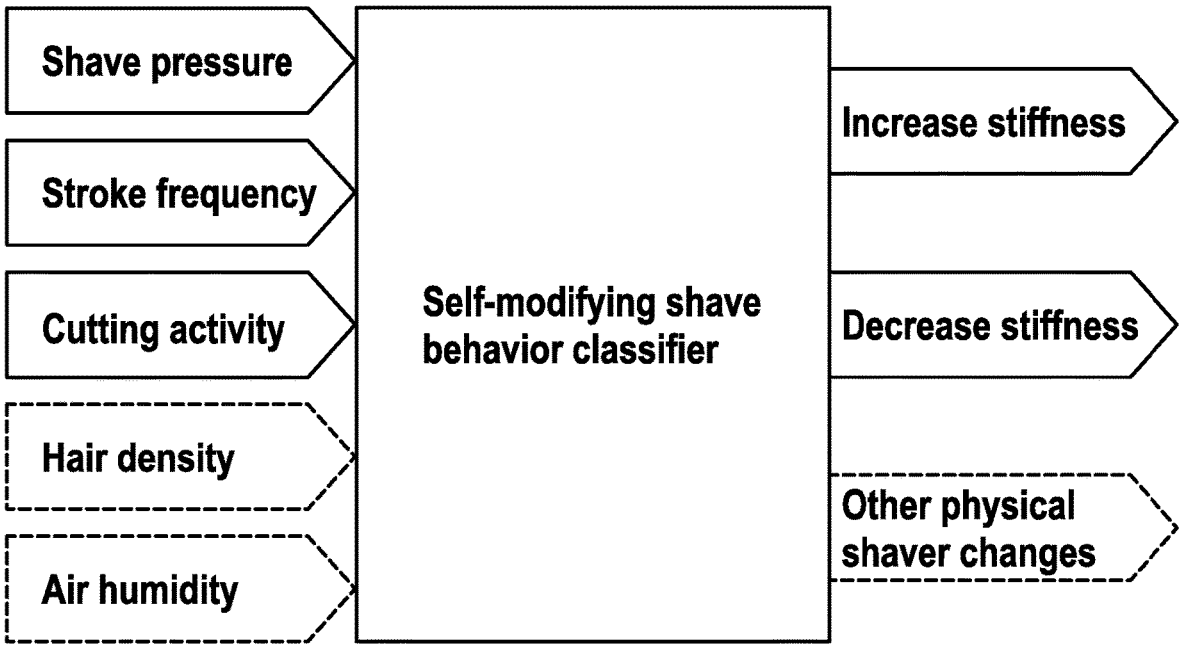
FIG. 7: a schematic diagram showing the detected parameters and the shaver's working parameters adjusted in response thereto.

So as to have the full range of settings and/or adjustments for different users having different habits, a calibration device 60 may calibrate the relation between the pivoting stiffness and the detected force, as it is illustrated by FIG. 7. Otherwise a user applying always a rather high force just would get high pivoting stiffness, whereas another user usually applying only a slight force would get only low pivoting stiffness. To avoid such undesired situation, the calibration device 60 may take into account the user history of the detected force values. More particularly, an adaptive controller 61 may vary the algorithm in terms of, for example, a curve representing the relation between the pivoting stiffness t and the amount of force. For example, when the user history shows a rather high average force, the adaptive controller 61 may change a basic curve to a curve setting stiffness high only for higher force values. On the other hand, if user history shows a rather low average force, the curve may be varied to provide for higher stiffness already for lower forces.

In addition to detection of the aforementioned force, or in the alternative to such force detection, various other behavioral and/or environmental and/or physiological parameters may be detected, wherein the aforementioned calibration device 60 may provide for calibration of the control functions of such other treatment parameters in an analogous way.

More particularly, the following detectors may be provided (all or one of the following or any combination thereof):

- a touch detector 42 for detecting contact of the working head 3 with the body surface 30,
- a velocity and/or acceleration detector 43 for detecting velocity and/or acceleration of the personal care device,
- a rotation detector 44 for detecting rotation and/or orientation of the personal care device in three dimensions,
- a stroke speed and/or stroke length detector 48 for detecting a stroke speed and/or stroke length, wherein such stroke detector 48 may include an accelerometer,
- a stroke density detector 49 for detecting the number of strokes over a predetermined area of the body portion to be treated, wherein such stroke density detector 49 also may include an accelerometer,
- a distance detector 50 for detecting the distance of the shaver 1 and/or the user from a mirror, wherein such distance detector 50 may include a position sensor,
- a detector 51 for detecting pauses in shaving, wherein such detector 51 may include a contact sensor detecting shaver to skin contact or an ON-OFF switch,
- an angle sensor 52 for detecting a change in angle of the shaver head 3 to a user's face and/or a change in angle of the shaver handle 2 to a user's face and/or a change in angle of a shaver handle 2 to a user's hand or arm,
- a grip detector 53 for detecting a change in the type of grip such as moving the fingers higher up the shaver body and/or holding the handle 2 with a thumb on the frontside and the other fingers on the backside etcetera,
- a contact detector 54 for detecting a contact area between the shaver head 3 and the user's face and/or a change in said contact area, for example contact with only one cutter unit 4 and/or both cutter units 4,
- a hair detector 55 for detecting hair density and/or hair length,
- an environmental detector 56 for detecting air humidity and/or air temperature,
- a displacement detector 45 for detecting linear and/or rotatory displacement of the working head 3 relative to the handle 2,
- a cutting activity detector 46 for detecting cutting activity of the personal care device,
- a trimmer position detector 47 for detecting a position of a long hair trimmer
- a skin moisture sensor for sensing the skin moisture.

The shaver 1 further may be provided with a detecting unit for detecting or measuring other parameters relevant to the treatment, wherein such detecting unit may include a voltage and/or current detector for detecting power consumption of the drive unit during shaving and/or a time measurement means for measuring shaving time, for example.

Said control unit 80 may include a micro controller 21 which may receive signals indicative of the aforementioned parameters and may analyze such signals to determine the treatment parameters mentioned above, wherein the adjustment device 6 may be controlled by the micro controller 21 to adjust any of the mentioned working parameters.

On the basis of the detected parameters, the device may be adjusted in different ways. More particularly, the control algorithm $f_{control}$ of the control unit 80 may set the control output signals to control the adjustment actuators AA in accordance with a calculation rule and/or on the basis of a curve and/or a map implemented in said electronic control unit 80, for example in a memory device to which a micro-controller has access. As can be gathered from FIG. 2, such calculation rule and/or curve and/or map may be, however, modified by the aforementioned modification algorithm $f_{modify}$ in response to the modification input signals $S_{in,\ a\text{-}x}$. More particularly, said modification algorithm may be configured to continuously or repeatedly modify the control algorithm $f_{control}$ during effecting a personal care treatment by the personal care device.

In addition or in the alternative, the modification algorithm $f_{modify}$ may be configured to modify a calculation rule used by the control algorithm $f_{control}$ for calculating the output control signal on the basis of the behavioral input signal $S_{in,\ 1\text{-}n}$.

In addition or in the alternative, the modification algorithm $f_{modify}$ may be configured to modify a curve defining the relationship between the behavioral input signal and the output control signal and/or to modify a map defining the relationship between two or more behavioral input signals and at least one output control signal and/or to modify a map defining the relationship between at least one behavioral input signal and two or more output control signals.

In addition or in the alternative, the modification algorithm $f_{modify}$ may be configured to modify a data collection of the control algorithm $f_{control}$, wherein the modification algorithm $f_{modify}$ modifies at least one of the following: a number of behavioral input signals, a type of behavioral input signal, number of output control signals and a type of output control signal.

In addition or in the alternative, the modification algorithm $f_{modify}$ may be configured to apply at least one signal processing step to the modification input signal, said signal processing step including at least one of the following: a statistical evaluation including determination of a mean value and/or a spread and/or a minimum value and/or a maximum value and/or a median value and/or a sliding average of the modification input signal, a filtering of the modification input signal and/or of the behavioral input signal, a smoothening of the modification input signal and/or of the behavioral input signal, a mapping, an oversampling, an undersampling and/or a combination of the aforementioned signal processing steps.

In addition or in the alternative, the modification algorithm $f_{modify}$ may be configured to determine a difference of the modification input signal and/or the behavioral input signal from a reference parameter.

Figure 4:
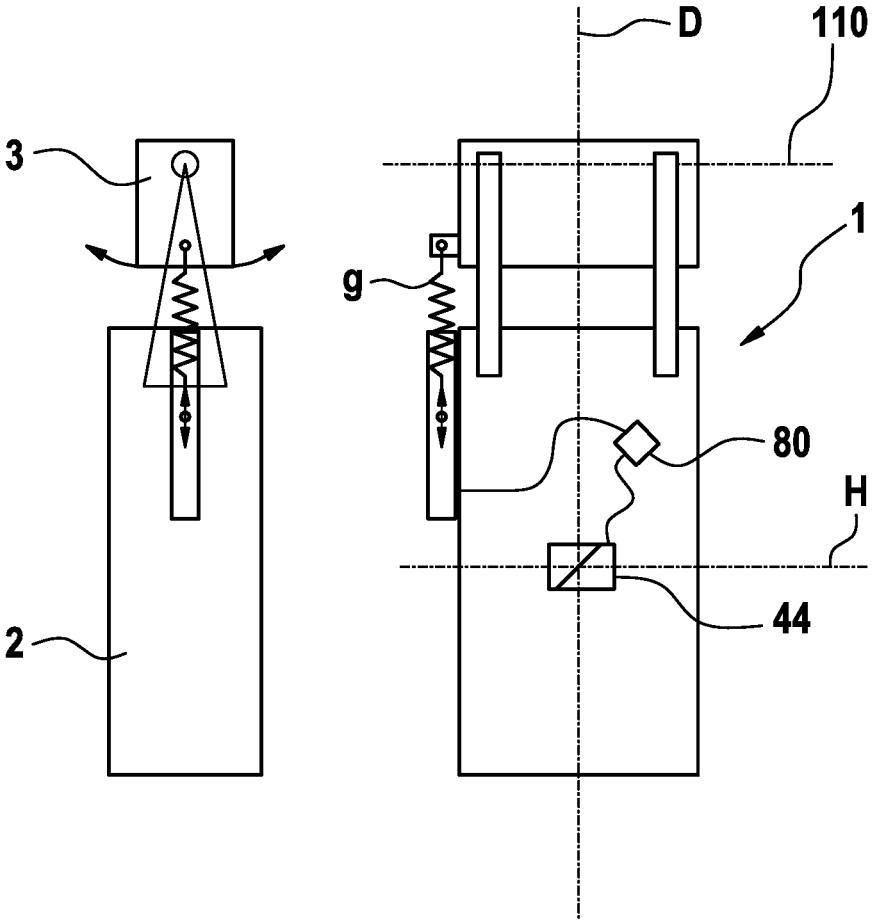
FIG. 4: a schematic front and side adjustment mechanism for adjusting views of the shaver head's pivoting stiffness.

Several examples of the control of the adjustment actuators and modification of such control include the following:

A dry electric shaver cuts the beard hairs best when shaving against the grain. Users typically know this, however they find it difficult to do so in the neck area and in particular flat lying hairs on the neck and make shaving here even more difficult. In response, when shaving the neck area, a user will typically rotate his shaver 1 around it's longitudinal axis (D) and change his grip such that the shavers front side points away from him. Additionally, the user then rotates the shaver around an axis (H) that is parallel to the swivel axis, as shown by FIG. 4. This is done automatically by the user, s/he typically will not notice that s/he is doing this. However, it is unergonomic and requires extra effort. The reason s/he intuitively moves the shaver 1 in this way is that for this situation a light swiveling head i.e. a low pivoting resistance is counterproductive. By behaving in this way, the user is able to reduce the swivel/pivoting movement.

Firstly, the shaver 1 recognizes this typically adapting behavior. This can be achieved by multiple different combinations of different sensors. In the embodiment shown in FIGS. 3 and 4, the use of an accelerometer 43 and a gyroscope 44 may be advantageous. The use of optical sensors, such as cameras, would be an alternative. This may optionally further be supported by the use of physiological and/or climatic data.

Based on usage and optionally physiological and/or climatic data from a high number of users and optionally the use of machine learning, the algorithm knows which typical data from the accelerometer and gyroscope indicate this behavior. Then, when this behavior is identified, a servomotor increases the preload of the spring (G) that connects head 3 and handle 2 to increase the stiffness of the shaver neck i.e. pivoting stiffness of the head 3 and reduce swiveling of the shaver head 3, cf. FIG. 4.

More particularly, the shaver head 3 which is movable relative to the shaver handle 2 with at least one degree of freedom e.g. in terms of rotation of shaver head 3 with respect to a rotation axis (herein called swivel axis (C)) that oriented orthogonally to the shaver handle's longitudinal axis (D)), wherein the shaver handle 2 is equipped with an accelerometer sensor (E) and a gyroscope. The accelerometer (E) is set up in a way to determine the spatial orientation and movement of the shaver 1 in relation to the surrounding gravitational field. The gyroscope is set up to determine twisting of the shaver 1 about its longitudinal axis. The relative movement of shaver head 3 to the handle 2 is controlled by an actuator (F), in this case a servomotor, which is set up to adjust the preload of a spring (G) that connects the shaver handle 2 to the shaver head 3. In addition, a camera system may also be included that identifies the location of flat lying hairs.

The extent to which the users rotate the shaver 1 about both axes and the speed at which they do this varies greatly, not only between different users but as well between different shaves or even during a shave. Therefore, an automatic self-modifying algorithm may be provided within the control unit (I) that controls the preload adjustment of the spring (G) based on continuous monitoring of the accelerometer data, calculating sliding average and sliding spread values on different timescales (=with variable probing times). In this way, the shaver reacts individually to the users shaving behavior to achieve a smother, more effortless shave.

Figure 3:
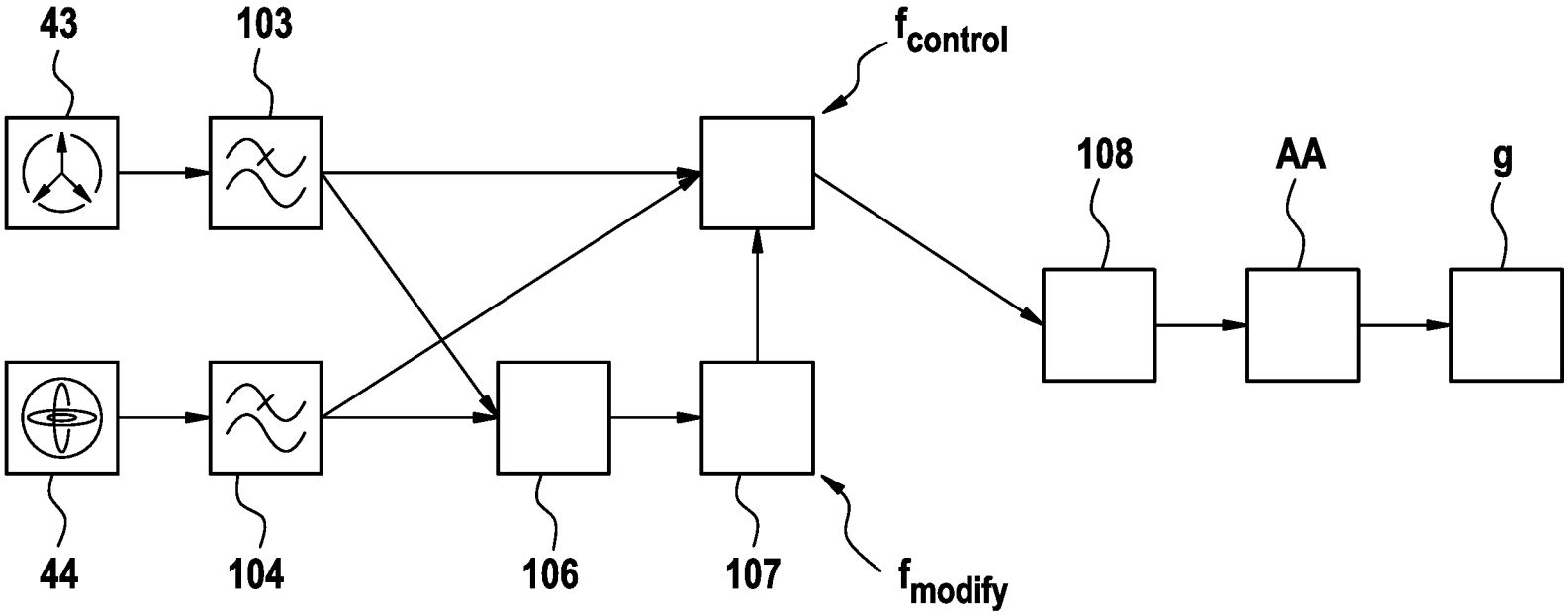
FIG. 3: a schematic diagram illustrating the interaction of the control algorithm and modification algorithm and the flow of input and output signals according to an example.

More particularly, as can be seen from FIG. 3, an average value of the signal from the acceleration sensor 43 in an x-direction (of the shown coordinate system) is taken. Disturbing frequency components, resulting from vibrations of the shaver are filtered out by the filter 103 (figure of information flow). The signal is used by the control algorithm $f_{control}$ to control the actuator AA. The position of the actuator AA may be calculated by the control algorithm $f_{control}$ as the sum of an offset and a contribution proportional to the acceleration in x-direction, measured by the acceleration sensor 43.

Finally, the control algorithm $f_{control}$ includes a low pass filter that removes disturbing frequency components above a specific value of e.g. 1 Hz. A logic block 106 of the modification algorithm $f_{modify}$ may calculate the sliding average of the x-value of the acceleration sensor 43. The time constant is e.g. as long as the duration of an average shave. The logic block 107 of the modification algorithm $f_{modify}$ may take this average value continuously, i.e. frequently and without being triggered by the user and replaces the before mentioned offset in the control algorithm $f_{control}$ with this value.

In this case, it is chosen to take changes in user shaving behavior with time into account (e.g. when the shaving behavior changes in summer or winter time), so e.g. the last ten shaves are stored and used to modify the reference values of the control algorithm $f_{control}$ to fit this particular user. Alternatively, all previous shaves values can be considered for the modification of the algorithm, here a higher weighting may be given to more recent shaves.

Furthermore, the success rate of identifying the need for this adjustment can be further increased by also integrating the sensor data from gyroscope 44, filtered by filter 104 into the modification algorithm's $f_{modify}$ calculation, as in such moments the users may increase their twisting of the shaver body around its longitudinal axis D.

The device may optionally have an interface to enable connection for data transfer, either to transfer data from outside to the microprocessor, e.g. to update the database with data from multiple users or to transfer data from the shaver to outside, e.g. to display information on a smart phone.

According to another example, findings such as numerical data from consumer research (e.g. pressing the shaver harder on the face than normal for an individual user suggests that he is adapting his behavior) may be taken into account for adjusting the shaver. For example, the shaver 1 may collect shave data from a particular user, so learns what his typical behavior is (e.g. each man naturally presses the shaver with his own individual pressure against the skin) and can identify when his behavior varies from this.

The shaver head 3 may be mounted so that it can swivel or tilt relative to the handle 2, as shown by FIGS. 1 and 4. A flexible shaving head 3 gives freedom how to hold the device, while enabling good adaptation to different face regions. The shaving head 3 can follow the different contours of checks, neck and jawline. This also ensures that for as much of the time as possible the complete cutting element area is in contact with the skin independent of the angle at which the user holds the shaver (within a certain range). This ensures maximum cutting area contact with the face brings the advantages of better efficiency (a quicker shave) and better skin comfort as the pressing force is spread over a larger area leading to lower pressure on the skin.

However, it has been identified that for certain shave behaviors and/or at certain moments in the shave, a low pivoting stiffness can be disadvantageous. Two examples are listed below:

1. a feeling of a loss of control can arise when a user presses his shaver with particularly high pressure against his face and the head swivels away suddenly;
2. not easy to apply targeted high pressure to a single foil (e.g. some users do this to increase the pressure at the end of the shave for increased closeness). A light swivel typically results in the head rotating so that all cutting elements touch the face.

A typical reaction to these situations is that users will adapt how they hold the shaver 1 in their hand. They change the angle of their hand and the shaver 1 so that the shaver handle 2 lies at an extreme angle such that the head 3 cannot swivel any further. However this is unergonomic and extra effort.

The current solution typically offered for these issues is a manual lock for the shaving head which can be activated. The consumer can decide between the flexible and the locked settings, however this can be inconvenient, is an extra step (again more effort) and consumers often try other alternatives (e.g. holding the head with their fingers).

According to another aspect, there may be automatically adapting the force that resists the swivel movement based on behavioral detection (e.g. detects shaving pressure, detects direction and speed of movements, detects angle of shaver handle, detects which cutting elements have contact to the skin). The algorithm that controls the swivel stiffness may modify itself based on the typical behavior of this particular user that it detects over time.

Figure 5:
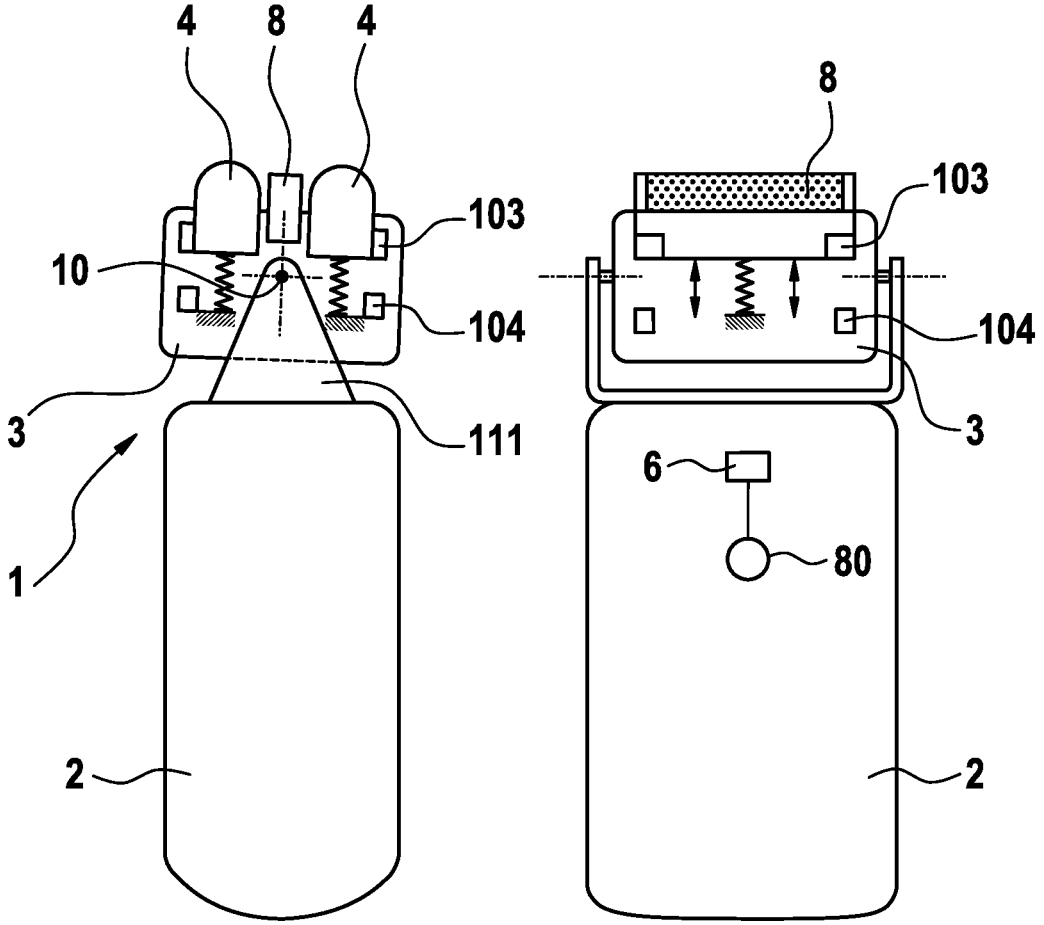
FIG. 5: schematic front and side views of a shaver similar to FIG. 2 with a detector for detecting individual diving of the cutter elements to determine shaving pressure according to a further embodiment.
Figure 6:
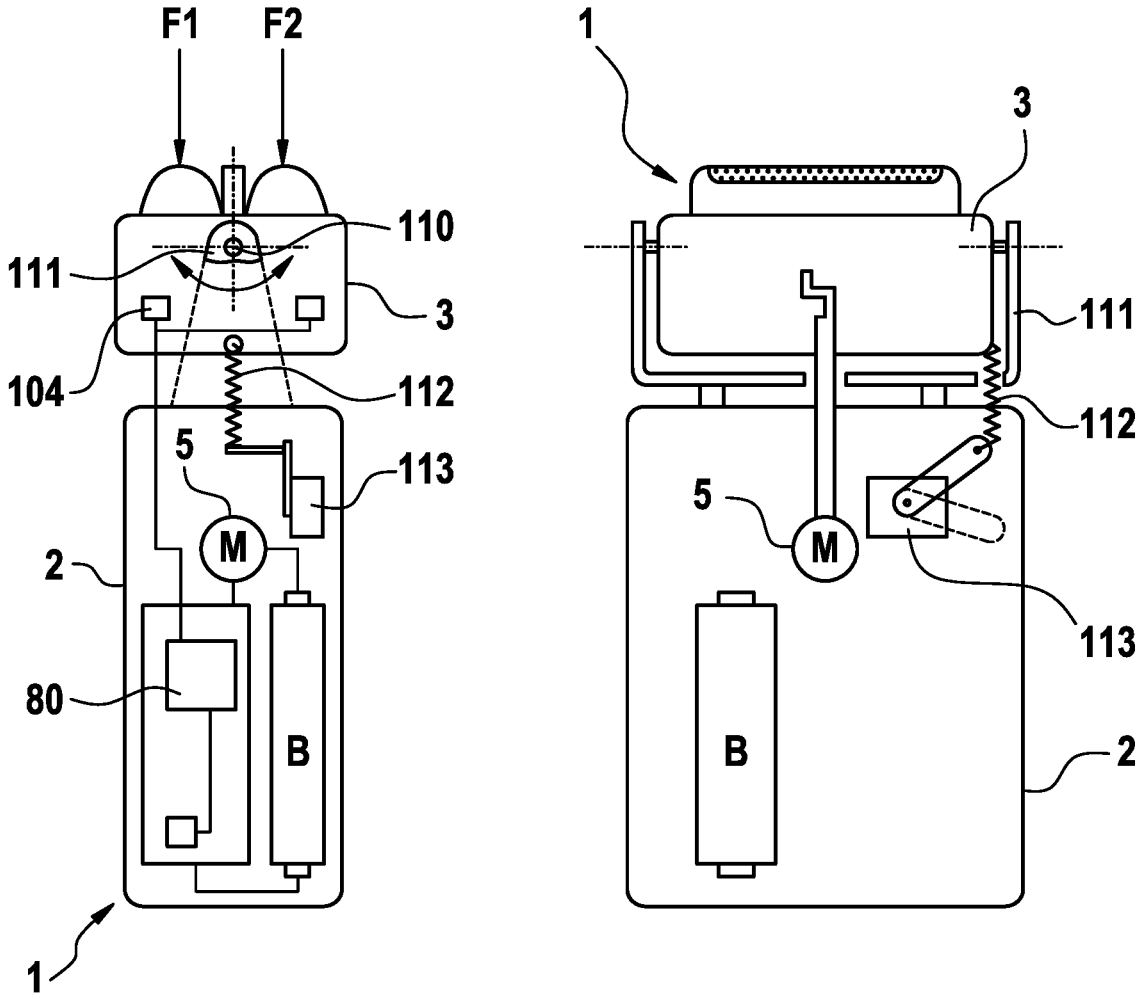
FIG. 6: schematic front and side views of a shaver similar to FIGS. 2 and 3 having the adjustment mechanism for adjusting pivoting stiffness and the detector for detecting diving or floating according to a further embodiment.

More particularly, the shaver 1 with a swivel head 3 is equipped with pressure sensor 41 and a sensor 43 that detects directions and speed of motion. One or more cutting elements 4 are spring loaded and carry small magnets 103, cf. FIG. 5. The higher the shaving pressure, the more the cutting elements 4 are pressed down. This movement is tracked via hall sensors 104 under each cutting element. The hall sensors are connected to the electronic control unit 80 on the internal PCB of the shaver. Mounted on the PCB may be an accelerometer to detect acceleration of all three axes of the device.

The electronic control unit 80 receives the signals of the hall sensors 104 and the accelerometer. A mathematic function translates the signals into pressure and movement data. E.g. the consumer starts to apply higher shaving pressure than typical the cutting elements 4 are moving deeper into the shaving head 3. Or the movements are faster and shorter. The electronic control unit 80 receives these untypical signals from the hall sensors 104 and the accelerometer and translates it to untypical pressure and movement values. These values are compared with a given matrix of values in real time within the control unit 80 and evaluated to generate the assigned signal for the actuator 113. In this example the spring 112 will be pulled to set a specific stiffness of the swing head 3.

Based on previous usage (e.g. other phases in the same shave and/or previous shaves), the algorithm adjusts the e.g. pressure ranges that are considered to be "low", "medium" or "high. E.g. for a man who typically shaves with a pressure of 1-2 N, the shaver would learn to consider 2N to be a high pressure for this user, whereas for a man who typically shaves with a pressure of 3-5 N, the shaver would learn to consider 2N to be low pressure for this user.

The self-modifying phase of the algorithm starts with the beginning of the first shave: The electronic of the shaver creates medium values. The more shaves are done, the accurate are the stored typical range.

The shaver body may contain a drive motor 5 and a battery 109. The swing head 3 is mounted on an axis 110 which is mounted on a holder 2 of the shaver body. When asymmetric shaving pressure is applied to the shaving system—means more pressure F1 on one of the both foils than F2 on the other—a torque occurs and the shaving head swings around its axis (10) to align on facial contours. The counterforce of the swinging head is minimized to ensure a good adaptation of the shaving system even when low pressure is applied. A pulling spring 112 is mounted between the lower end of the head and the shaver body. The spring sets the force to swing the head. The stronger the spring is set the harder the head can swing. An actuator 113 is attached to the shaver body and holds the end of the spring. It can set the pre-load of the spring 112 by changing the length of the spring. In neutral actuator position the spring has the lowest pre-load and the swing head can swing very easy. At max. actuation the spring is pulled tight and the shaving head needs more shaving pressure to get moved.

The consumer feels a more stiff and rigid system. The actuator can set the spring load step-less between min. and max. actuation position.

According to a still further embodiment, the user may be requested to enter data directly e.g. via a smart phone or another device or directly into the shaver in order to provide the algorithm with additional data. This may be a onetime input e.g. after purchase or be requested on a regular basis, wherein such input may be effected, for example, by voice and voice recognition. This input can then be used to assess, e.g.:

- what is of particular importance to this individual user (e.g. some men focus on closeness, whereas for others the top priority is no redness of skin)
- what problems the user currently has (e.g. missed individual longer hairs)
- details of his physiology that are relevant to shaving, e.g. does his have a particularly dense or sparse beard, does he have sensitive skin, etc.
- how he tries to solve his problems
- what sort of climatic conditions might be affecting his shave, e.g. does he typically shave before or after a shower?

Alternatively, the user may be requested to provide feedback about his shave over time. In this way, the algorithm can assess which of the modifications it made to the shaver were successful and further optimize how it reacts.

The data from multiple users can then optionally be collected and used to further refine the algorithm.

Optionally, feedback and/or instructions may also be given to the user. E.g.: when trying to shave single remaining hairs, try using less pressure (users typically apply more pressure in such situations, which is counterproductive)

In another specific example, the algorithm defining the adjustment of the shaver, as described in the previous example, may be a self-modifying classifier (e.g. a neural network). In this case, the outputs of the sensors (e.g. shave pressure, stroke frequency, cutting activity), optionally in combination with further parameters like physiological information from sensors/data entry (e.g. hair density) and/or climate data from sensors (e.g. air humidity), are linked to the input nodes of one or more shaving behavior classifiers. In the subsequent (hidden) layers of the classifier, the signals are processed and combined by a number of differentiating nodes. Finally, the classifier decides if the current shaving behavior, optionally combined with further parameters named above in this paragraph, requires increasing or decreasing of the shaver head retention spring preload and thus a firmer or less firm feel of the shaving system on the skin.

To initially define the classifier, it is trained using labelled shave behavior data of a large number of test shaves in advance (factory level). The system then is able to adjust itself more detailed to the user by learning his specific user behavior and optionally further parameters (user-at-home level) and his reactions to the adjustments made by the system and/or by updating the classifier with a further trained version from a web-based source (cloud level). For the latter, data of many different users and shaves is collected to enlarge the training dataset. Training in this context means that the links between differentiation nodes are adjusted, weighted or added/deleted systematically and automatically in order to improve the classifier performance.

According to a further aspect, high air humidity leads to sticky skin which means that the frictional forces between skin and shaving foils/trimmers are increased. This leads to a phenomenon called "stick-slip-effect" where the shaver alternately slips easy over the skin or sticks to the skin. This makes shaving more difficult and uncomfortable. Users react in a variety of ways to this, typically they may adapt their behavior to the product-environment situation by reducing the shaving pressure they use. As however a general reduction in shaving pressure can have multiple causes, in this situation an additional air humidity sensor could be used in order that the algorithm can identify the appropriate shaver adjustment for this specific situation, such as increasing the stiffness of the shaver neck (spring pre-load) to reduce the uncontrolled swiveling of the head caused by the stick-slip.

When shaving a longer beard (e.g. 4 days growth and more), a user will typically adapt his behavior to the product-physiological (longer beard hairs) situation in that he moves the shaver slower than normal. A typical reason for this is that if the user is not careful, the longer hairs can get caught in the foils and tug, which is painful. This slowing down requires concentration (extra effort) and more time. Automatically raising the trimmers in the shaver head so that the beard hairs now just enter the trimmers and no longer the foils can enable to the user to move the shaver at the normal speed, even with longer beard hairs. However, as this is a fairly dramatic change to the shaver, it may be advisable to have a second sensor type (e.g. optical sensor such as a camera that detects hair length) to ensure this is the reason for the change of behavior. Time since last usage is not considered sufficient information as many men use wet razors in addition to electric dry shavers.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

What is claimed is:

1. A method for controlling a personal care device comprising a working head including at least one cutter unit, comprising the following steps:

- detecting at least one behavioral parameter indicative of a user's behavior during handling the personal care device when effecting a personal care treatment to a body surface,
- adjusting at least one working parameter of the personal care device in response to the detected at least one behavioral parameter by an adjustment actuator controlled by an electronic control unit provided with (i) a control algorithm for calculating an output control signal for the adjustment actuator in response to at least one behavioral input signal indicative of the detected at least one behavioral parameter during the personal care treatment, and (ii) a modification algorithm for modifying the control algorithm,
- modifying the control algorithm with the modification algorithm on the basis of at least one modification input signal during the personal care treatment, wherein said at least one modification input signal and said at least one behavioral input signal come from the same detector and correspond to the same detected behavioural parameter.

2. A personal care device comprising an elongated handle for manually moving the personal care device along a body surface, a working head comprising at least one cutter unit and attached to said handle for effecting a personal care treatment to said body surface, at least one detector for detecting at least one behavioral parameter indicative of a user's behavior during handling the personal care device when effecting the personal care treatment, and an adjustment device for adjusting at least one working parameter of the personal care device in response to the detected behavioral parameter, said adjustment device including an adjustment actuator controlled by an electronic control unit provided with a control algorithm for calculating an output control signal for the adjustment actuator in response to at least one behavioral input signal indicative of the at least one detected behavioral parameter, wherein said electronic control unit is provided with a modification algorithm for modifying the control algorithm on the basis of at least one modification input signal, wherein said at least one modification input signal and said at least one behavioral input signal come from the same detector and correspond to the same detected behavioural parameter.

3. The personal care device according to claim 2, wherein the modification algorithm is configured to continuously or repeatedly modify the control algorithm during effecting the personal care treatment by the personal care device and/or during operation of the adjustment actuator.

4. The personal care device according to claim 2, wherein said at least one modification input signal and said behavioral input signal are provided at different points of time with the behavioral input signal representing real time data of a user's current behavior and the modification input signal representing at least one of historical data detected in the past during a past personal care treatment or a past portion of the current personal care treatment, and both indicate behavior of the same user at different points of time during handling the personal care device when effecting the personal care treatment.

5. The personal care device according to claim 2, wherein the modification algorithm is configured to modify a calculation rule used by the control algorithm for calculating the output control signal for the adjustment actuator.

6. The personal care device according to claim 2, wherein the modification algorithm is configured to modify a map defining a relationship between two or more behavioral input signals and the output control signal.

7. The personal care device according to claim 2, wherein the modification algorithm is configured to modify a data collection of the control algorithm, wherein the modification algorithm modifies at least one of the following: a number of behavioral input signals, a type of behavioral input signal, number of output control signals and a type of output control signal.

8. The personal care device according to claim 2, wherein the modification algorithm is configured to apply at least one signal processing step, said signal processing step including at least one of the following: a statistical evaluation including determination of a mean value, a minimum value and a maximum value of the at least one modification input signal, a filtering of the at least one modification input signal and of the at least one behavioral input signal, a smoothening of the at least one modification input signal and of the at least one behavioral input signal, a mapping, an oversampling, an undersampling, a weighting or a combination of the aforementioned signal processing steps.

9. The personal care device according to claim 2, wherein the modification algorithm is configured to determine a difference of the at least one modification input signal and the at least one behavioral input signal from a reference parameter.

10. The personal care device according to claim 2, wherein a calibration device is provided for calibrating the adjustment device on the basis of a user history of the at least one behavioral parameter detected during a current treatment session and a previous treatment session.

11. The personal care device according to claim 10, wherein said calibration device includes an adaptive controller for adaptively controlling the adjustment device.

12. The personal care device according to claim 10, wherein said calibration device is configured to calibrate said adjustment device continuously or repeatedly during each personal treatment session.

13. The personal care device according to claim 2, wherein said adjustment device is configured for adjusting at least one of the following working parameters of the personal care device: pivoting stiffness of the working head, operation of a long hair cutter, temperature of a cooling/heating device and operation of a lubricant applicator, position of different cutting and non-cutting elements relative to each other, floating stiffness of working elements for effecting the personal care device, or pivoting stiffness of working elements, in response to a signal of at least one of the following detectors:

a touch detector for detecting contact of the working head with a user's body, acceleration detector for detecting acceleration of the personal care device, a rotation detector for detecting orientation of the personal care device in three dimensions, a stroke speed detector for detecting a stroke speed, a stroke density detector for detecting the number of strokes over a predetermined area of the body surface to be treated, a distance detector for detecting the distance of the personal care device from a mirror, a detector for detecting pauses in the personal care treatment, an angle sensor for detecting a change in angle of the working head to a user's face, a grip detector for detecting a change in the type of grip on the handle, a contact detector for detecting a change in said contact area, a hair detector for detecting hair density, an environmental detector for detecting air temperature, a displacement detector for detecting displacement of the working head relative to the handle, a cutting activity detector for detecting cutting activity of the personal care device, a trimmer position detector for detecting a position of a hair trimmer, a contact force detector for detecting the force at which the working head is pressed against user's skin, or a skin moisture sensor for sensing the moisture of the skin.

14. The personal care device according to claim 2, wherein the working head is pivotably supported relative to the handle about at least one pivot axis, wherein the adjustment device is configured to adjust a pivoting stiffness of the working head about said at least one pivot axis in response to the at least one detected behavioral parameter.

15. The personal care device according to claim 2, wherein said at least one detector comprises a contact force detector for detecting the force at which the working head is pressed against a user's skin, wherein the adjustment device is configured to increase the pivoting stiffness of the working head when the detected skin contact force reaches or exceeds a predetermined value.

16. The personal care device according to claim 2, wherein said at least one detector comprises a grip detector for detecting a type of grip on the handle, wherein the adjustment device is configured to adjust the pivoting stiffness of the working head in response to the detected type of grip.

17. The personal care device according to claim 2, wherein said at least one detector comprises an angular orientation detector for detecting an angular orientation of a longitudinal axis of the handle relative to an angular rotation of the handle, wherein the adjustment device is configured to adjust the pivoting stiffness of the working head in response to the detected angular orientation of the longitudinal axis of the handle relative to the angular rotation of the handle.

18. The personal care device according to claim 2, wherein said at least one detector comprises an environmental detector for detecting an environmental parameter selected from the group of air temperature, air humidity and skin moisture, wherein the adjustment device is configured to adjust the pivoting stiffness of the working head in response to the detected environmental parameter.

19. The personal care device according to claim 2, wherein said at least one detector comprises a hair detector is provided for detecting a hair density on a body portion to be treated, wherein the adjustment device is configured to adjust the pivoting stiffness of the working head in response to the detected hair density.

* * * * *